US010557320B2

(12) United States Patent
Arbelaez et al.

(10) Patent No.: US 10,557,320 B2
(45) Date of Patent: Feb. 11, 2020

(54) TUBULAR PIN CONTROL SYSTEM

(71) Applicant: FORUM US, INC., Houston, TX (US)

(72) Inventors: Juan Arbelaez, Houston, TX (US); Joshua Brandon Meuth, Giddings, TX (US); Aaron Bryant, Tomball, TX (US)

(73) Assignee: FORUM US, INC., Houston, TX (US)

( * ) Notice: Subject to any disclaimer, the term of this patent is extended or adjusted under 35 U.S.C. 154(b) by 216 days.

(21) Appl. No.: 15/054,673

(22) Filed: Feb. 26, 2016

(65) Prior Publication Data

US 2016/0251916 A1 Sep. 1, 2016

Related U.S. Application Data

(60) Provisional application No. 62/126,318, filed on Feb. 27, 2015.

(51) Int. Cl.
*E21B 19/15* (2006.01)

(52) U.S. Cl.
CPC ..... *E21B 19/155* (2013.01)

(58) Field of Classification Search
CPC ..... E21B 19/15; E21B 19/155
USPC ..... 414/22.51–22.71
See application file for complete search history.

(56) References Cited

U.S. PATENT DOCUMENTS 3,792,783 A * 2/1974 Brown ..... E21B 19/15 175/85
4,067,453 A 1/1978 Moller
4,316,693 A * 2/1982 Baxter ..... B65G 57/22 198/468.3
4,332,411 A * 6/1982 Ellzey ..... E21B 19/155 294/104
4,621,974 A * 11/1986 Krueger ..... E21B 19/20 211/70.4
5,695,044 A * 12/1997 Morikiyo ..... B61B 10/04 104/162
6,926,488 B1 * 8/2005 Bolding ..... E21B 19/15 211/70.4
7,021,880 B2 * 4/2006 Morelli ..... E21B 19/15 414/22.59

(Continued)

FOREIGN PATENT DOCUMENTS

CN 101278103 A 10/2008
CN 101925718 A 12/2010

(Continued)

OTHER PUBLICATIONS

International Search Report and Written Opinion for Application No. PCT/US2016/019151 dated May 18, 2016.

(Continued)

*Primary Examiner* — Lynn E Schwenning
(74) *Attorney, Agent, or Firm* — Patterson & Sheridan, L.L.P.

(57) ABSTRACT

In one embodiment, a skate configured to engage a tubular while moving along a catwalk trough is provided. The skate comprises a frame having a drive system configured to move the tubular along the catwalk trough, a grip device coupled to the frame and configured to grip a pin end of the tubular, and a controller in communication with the drive system that controls movement of the frame based on movement of a box end of the tubular.

19 Claims, 8 Drawing Sheets

(56) References Cited

U.S. PATENT DOCUMENTS

| | | | | |
|---|---|---|---|---|
| 7,832,974 | B2 * | 11/2010 | Fikowski | E21B 19/155 414/22.54 |
| 8,033,779 | B2 * | 10/2011 | Gerber | E21B 19/15 14/71.1 |
| 8,511,963 | B1 * | 8/2013 | Bunch | E21B 19/155 414/22.57 |
| 8,840,352 | B2 * | 9/2014 | Taggart | E21B 19/155 414/22.54 |
| 8,888,432 | B1 | 11/2014 | Guidroz et al. | |
| 9,422,779 | B1 * | 8/2016 | Bunch | E21B 19/155 |
| 2004/0208730 | A1 * | 10/2004 | Morelli | E21B 19/15 414/22.59 |
| 2006/0285941 | A1 * | 12/2006 | Fikowski | E21B 19/155 414/22.54 |
| 2007/0221385 | A1 | 9/2007 | Braun et al. | |
| 2011/0188973 | A1 | 8/2011 | Baumler | |
| 2011/0226530 | A1 * | 9/2011 | Tarique | E21B 19/155 175/27 |
| 2011/0259640 | A1 * | 10/2011 | Gerber | E21B 19/14 175/52 |
| 2012/0121364 | A1 * | 5/2012 | Taggart | E21B 19/155 414/22.59 |
| 2013/0266404 | A1 * | 10/2013 | Tolman | E21B 19/15 414/22.59 |
| 2014/0140791 | A1 * | 5/2014 | Yorga | E21B 19/14 414/22.59 |
| 2014/0205417 | A1 * | 7/2014 | Tetley | E21B 19/15 414/746.8 |
| 2016/0017674 | A1 * | 1/2016 | Richardson | E21B 19/155 175/24 |

FOREIGN PATENT DOCUMENTS

| | | | |
|---|---|---|---|
| CN | 202370456 | U | 8/2012 |
| CN | 103556960 | A | 2/2014 |
| WO | 0123701 | A1 | 4/2001 |

OTHER PUBLICATIONS

Canadian Office Action dated Oct. 22, 2018 for U.S. Appl. No. 2,974,602.

Chinese Office Action dated Jul. 24, 2018 for Application No. 201680012052.8.

Chinese Office Action dated Mar. 28, 2019 for Application No. 201680012052.8.

Canadian Office Action dated Jul. 30, 2019 for U.S. Appl. No. 2,974,602.

* cited by examiner

TUBULAR PIN CONTROL SYSTEM

CROSS-REFERENCE TO RELATED APPLICATION

This application claims benefit of U.S. Provisional Patent Application Ser. No. 62/126,318, filed Feb. 27, 2015, which is hereby incorporated by reference herein.

BACKGROUND

Field

Embodiments disclosed herein generally relate to catwalks for conveying tubulars between a drill floor and a lower level of a drilling rig or drill site. Specifically, embodiments disclosed herein relate to a system and method for moving tubulars along the catwalk.

Description of the Related Art

In a drilling operation or rig work-over operation, whether on a water-based (offshore) or a land-based drilling rig, tubulars, such as drill pipe, risers, casing or other tubulars, are often stored at, or supplied from, a level that is below the drill floor. The tubulars must be transported to the drill floor from a storage location at the lower level and then may be transported back to the storage location from the drill floor. The tubulars may be transferred using equipment such as a gantry crane, a knuckle boom crane, a horizontal to vertical (HTV) arm, or a conveyor such as a "catwalk" to move the tubulars between the storage location and the drill floor, and vice versa. When using a catwalk, tubulars are typically mechanically transported (e.g. pushed and/or pulled) in a v-shaped trough, from the storage location below the rig floor to the rig floor, and vice versa.

Some tubulars, such as drill pipe, include threaded mating connections on opposing ends. One end of the drill pipe has a male (e.g., a "pin") connection whilst the other has a female (e.g., a "box") connection, and the end having the pin is typically the end that is pushed or pulled in the trough of the catwalk. The end having the box connection is typically lifted by an elevator or other lifting device during transfer of the pipe.

Sliding of the pin connection along the trough may damage the threads of the pin connection. Conventionally, thread protectors made of steel, plastic or other suitable material, are available. However, the protectors add additional costs and labor to the drilling operation when used. Additionally, while the trough provides some control of the tubulars in a pushing or pulling operation, the end of the tubular sliding in the trough is a "free end". Thus, additional control of the end of the pipe with the pin connection is desired.

What is needed is a method and apparatus that provides control of the pin connection of tubulars.

SUMMARY

In one embodiment, a skate configured to engage a tubular while moving along a catwalk trough is provided. The skate comprises a frame having a drive system configured to move the tubular along the catwalk trough, a grip device coupled to the frame and configured to grip a pin end of the tubular, and a controller in communication with the drive system that controls movement of the frame based on movement of a box end of the tubular.

In another embodiment, a skate for coupling with a tubular along a length of a catwalk trough is provided. The skate comprises a frame having a drive system for moving the tubular along the length of the catwalk trough, a grip device disposed on the frame for gripping and a pin end of the tubular, and a switch plate disposed on the grip device that controls a gripping surface of the grip device.

In another embodiment, a method for conveying a tubular to a drill floor is provided. The method includes positioning a tubular on a catwalk trough, coupling a box end of the tubular to an elevator, engaging a pin end of the tubular with a skate, and transferring the tubular by moving the skate along the trough to push the tubular while lifting the tubular with the elevator, wherein a controller in communication with the skate controls a position of the skate on the trough based on a position of the box end of the tubular.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1:
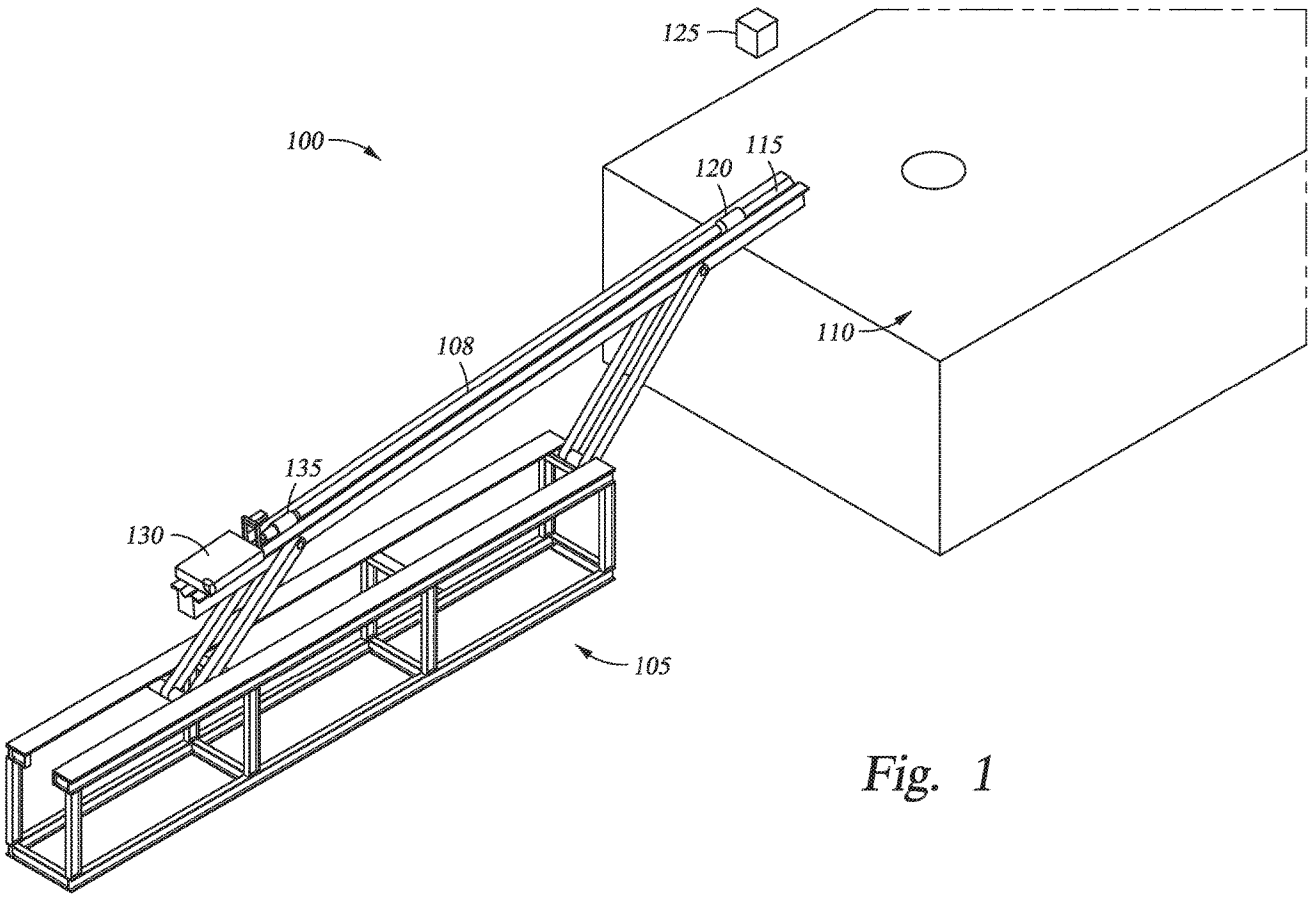
FIG. 1 is a schematic perspective view of a catwalk having a skate to move tubulars along a catwalk and onto a drill floor.

FIG. 1 is a schematic perspective view of a catwalk 105 next to a drill rig 100. The catwalk 105 is configured to convey a tubular 108 to and from a drill floor 110. The catwalk 105 includes a trough 115 along which the tubular 108 is conveyed to and from the drill floor 110. The tubular 108 has a box end 120 that may be coupled to an elevator 125, or other lift device, and raised or lowered to or from the drill floor 110. A skate 130 may engage a pin end 135 of the tubular 108. The skate 130 is powered to run along a length of the trough 115 of the catwalk 105 and may also be utilized to push or pull the tubular 108 during transfer of the tubular 108.

Figure 2:
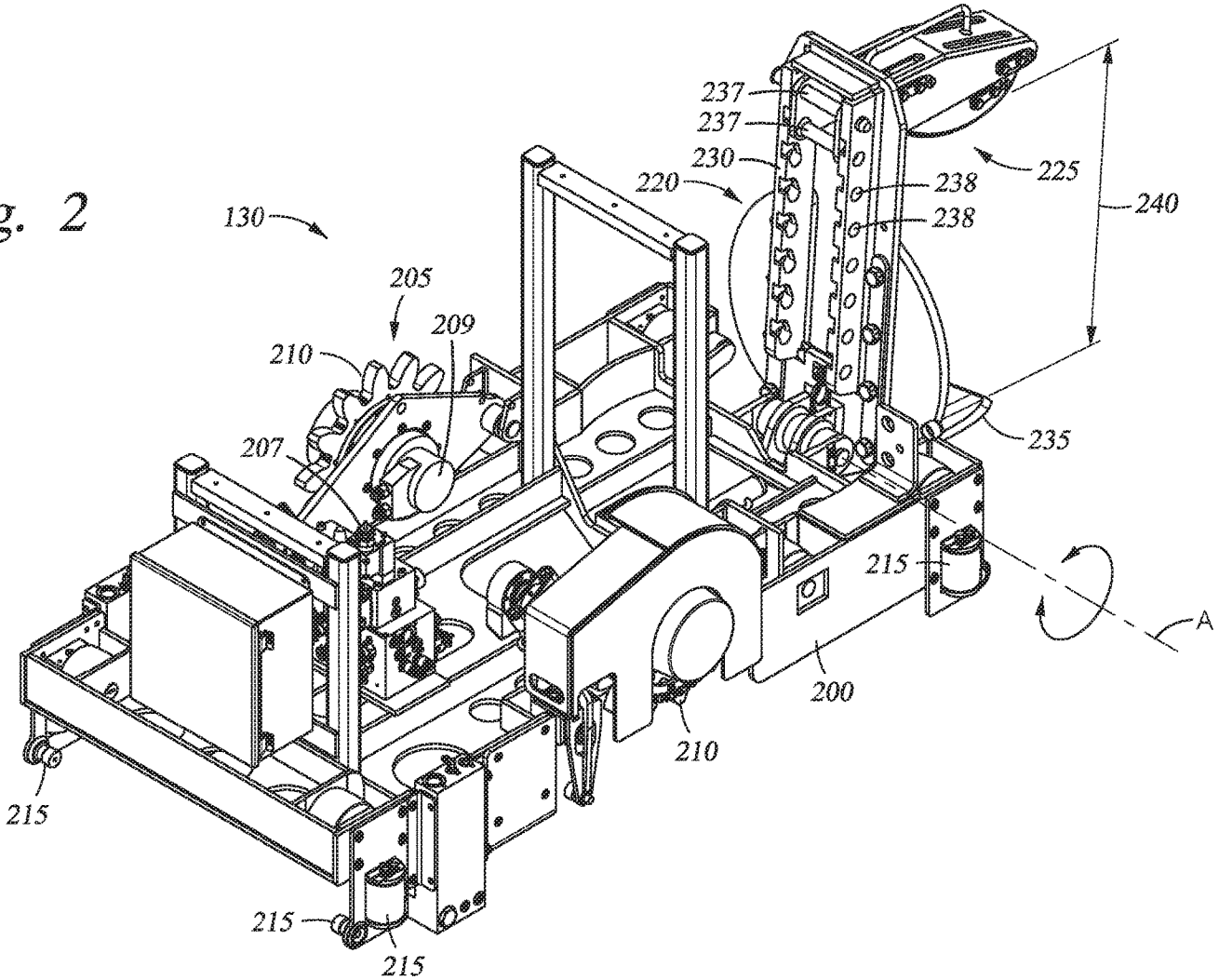
FIGS. 2 and 3 are isometric views of one embodiment of the skate that may be used with the catwalk of FIG. 1.
Figure 3:
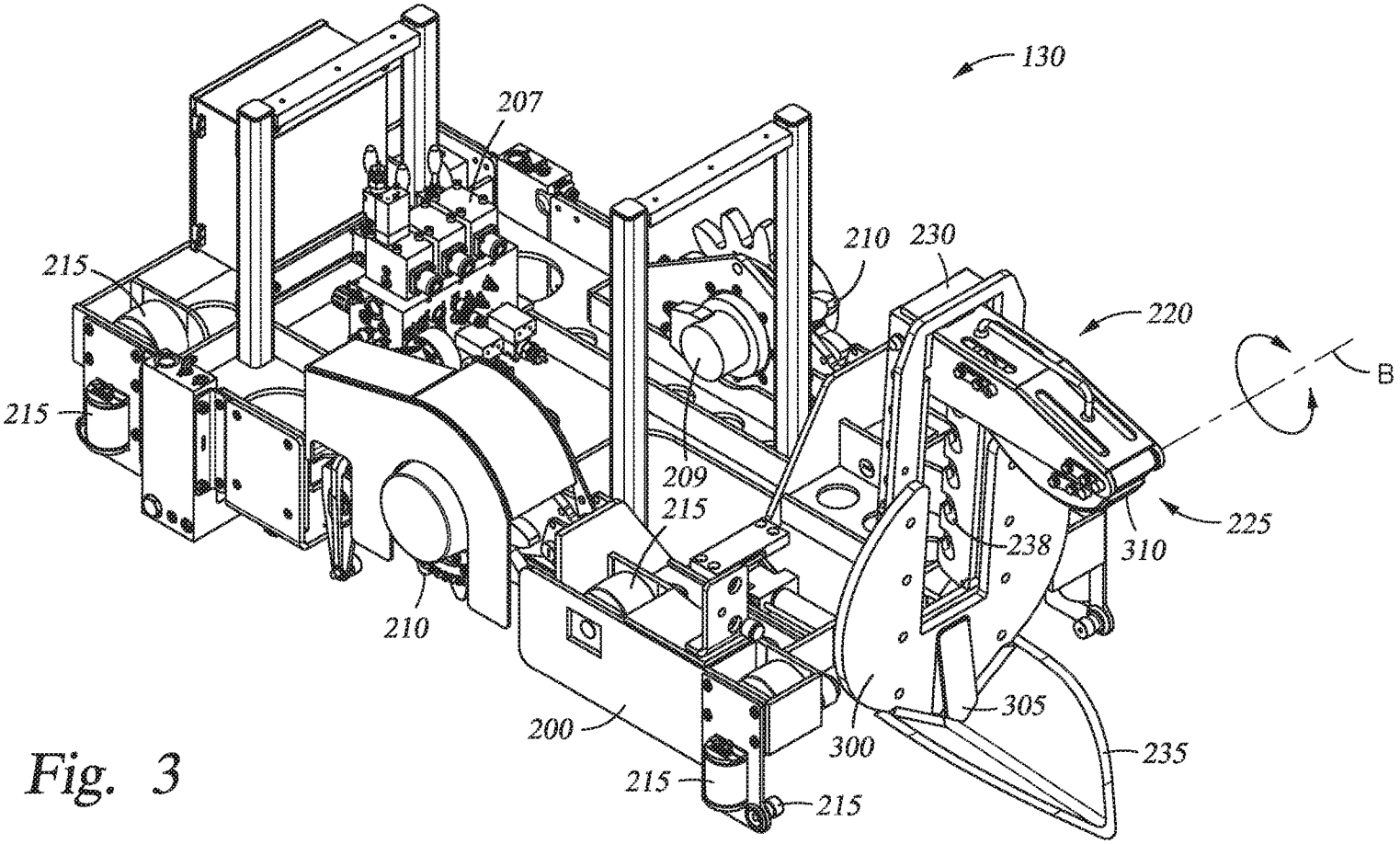

FIGS. 2 and 3 are isometric views of one embodiment of a skate 130 that may be used with the catwalk 105 of FIG. 1. The skate 130 includes a frame 200 having a drive system 205 that powers the skate 130 along the length of the trough 115 of FIG. 1. The drive system 205 in this embodiment includes a rack and pinion system, for example, a pair of pinion gears 210 that engage with a corresponding rack gear (not shown) disposed along the length of the trough 115 of FIG. 1. While the drive system 205 is shown and described as a rack and pinion system, other linear drive systems may be used, including chain drives or other geared drive systems. The drive system 205 may be powered hydraulically or electrically. In one embodiment, the skate 130 includes a valve block 207 that is operably coupled to hydraulic drive motors 209 (only one is shown in FIGS. 2 and 3) that drive each pinion gear 210. The frame 200 also includes guide rollers 215 that maintain stability of the skate 130 as the frame 200 travels along the trough 115 of FIG. 1.

The skate 130 also includes a tilting grip device 220 that may be used to receive the pin end 135 of the tubular 108 of FIG. 1. The grip device 220 includes a shovel 235 configured to support the tubular 108. The grip device 220 and the shovel 235 may be rotatable about at least a portion of an axis A (shown in FIG. 2) to account for angular changes in the tubular 108 during transfer of the tubular 108. The grip device 220 includes an adjustable clamp 225 that is positionable along the length of a support member 230. The adjustable clamp 225 is positioned opposite from the shovel 235. A distance 240 may be adjusted according to a diameter of the tubular 108 to be received in the grip device 220. The distance 240 is adjustable by adjusting the position of the adjustable clamp 225 along the support member 230. The adjustable clamp 225 may be adjustable by removing and inserting fasteners 237 in holes or slots 238 formed in the support member 230. The grip device 220 may be adjusted to receive tubulars having diameters of about 2 ⅜ inches to about 20 inches, or larger.

The grip device 220 includes a plate 300 (shown in FIG. 3) that acts as a stop for the tubular 108. The grip device 220 may also include a switch plate 305 positioned to extend out of a plane of the plate 300. The switch plate 305 may be used to actuate a grip member 310 of the adjustable clamp 225. For example, when a tubular is received in the grip device 220, the pin end of the tubular pushes the switch plate 305, and the switch plate 305 actuates the grip member 310 such that the grip member 310 moves toward the shovel 235. The grip member 310 may be rotatable about at least a portion of an axis B (shown in FIG. 3). A gripping surface of the grip member 310 may be roughened to facilitate a more secure grip on the tubular positioned between the shovel 235 and the grip member 310.

Figure 4A:
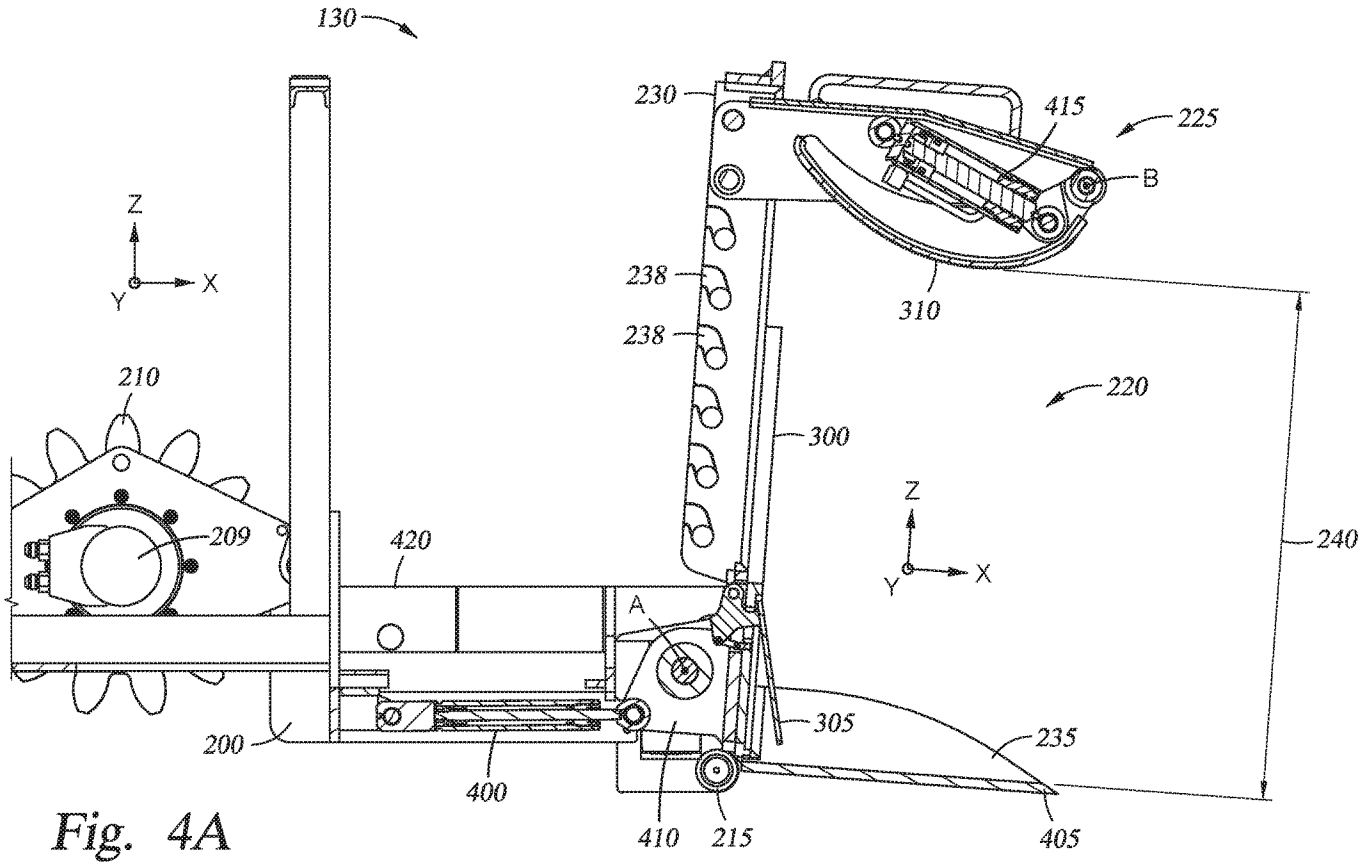
FIGS. 4A-4D are side cross-sectional views of a portion of a skate illustrating an operation and construction of a grip device of the skate, according to one embodiment.

FIGS. 4A-4D are side cross-sectional views of a portion of the skate 130 showing one embodiment of operation and construction of the grip device 220. The skate 130 is shown in FIG. 4A in a position to receive a tubular (along the Y direction) and move the tubular to the drill floor 110 (shown in FIG. 1) along the trough 115 of the catwalk 105 (both shown in FIG. 1). A plane of the plate 300 is generally in the Z plane and a plane of a surface of the shovel 235 is generally in the X plane. However, the Z and X planes of the grip device 220 may be slightly different than the Z and X planes of the frame 200. This offset may ensure that a tip 405 of the shovel 235 does not contact the tubular until the tubular is positioned in the grip device 220.

The position of the grip device 220 may be positioned in the Z plane by an actuator 400 coupled between the frame 200 and a hinge structure 410 of the grip device 220. The actuator 400 may be a hydraulic cylinder that is in fluid communication with the valve block 207 (shown in FIGS. 2 and 3).

Figure 4B:
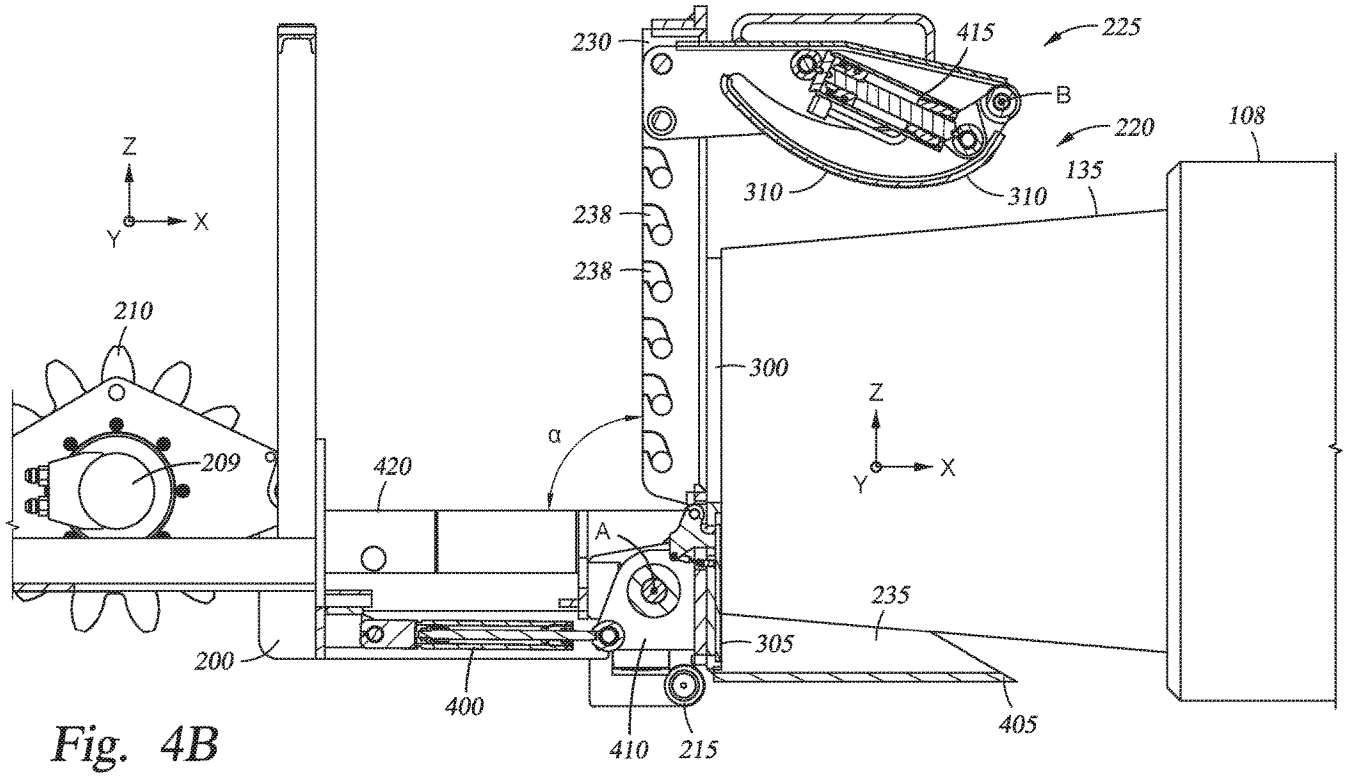

In FIG. 4B, the skate 130 is moved toward a pin end 135 of a tubular 108, and the pin head 135 contacts the plate 300 and also contacts the switch plate 305. The switch plate 305 is in communication with an actuator 415 that is used to pivot the grip member 310 about axis B. The actuator 415 may be a hydraulic cylinder that is in fluid communication with the valve block 207 (shown in FIGS. 2 and 3). In this position, a plane of the plate 300 is substantially normal to a plane 420 of the frame 200 such that an angle $\alpha$ therebetween is about 90 degrees (i.e., within about 5 degrees of a right angle).

Figure 4C:
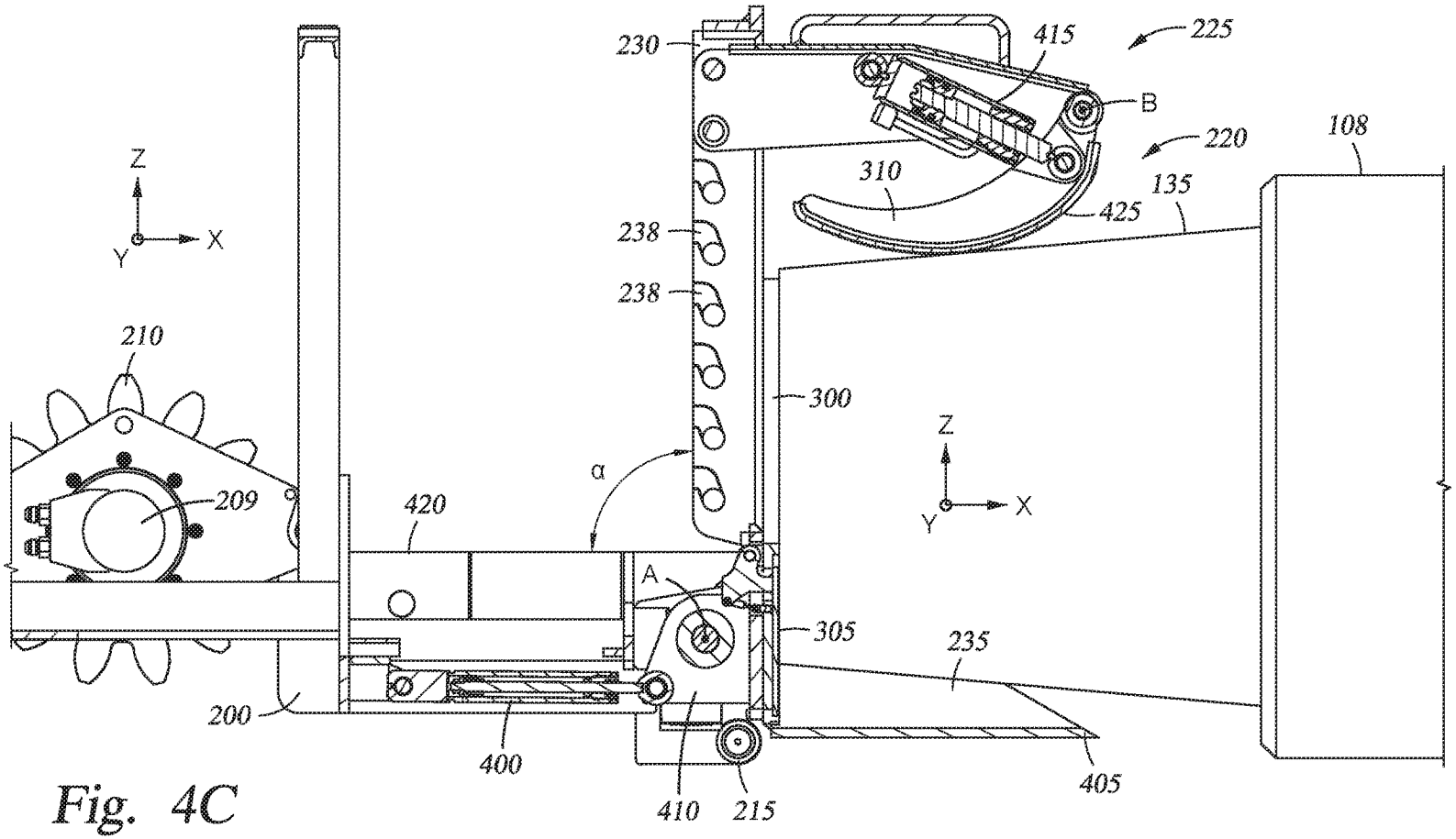

FIG. 4C shows a gripping surface 425 of the grip member 310 engaged with the pin end 135 of the tubular 108. The switch plate 305 actuates the actuator 415 to move the grip member 310 toward the pin end 135 of the tubular 108. In this position, the pin end 135 of the tubular 108 is secured between the gripping surface 425 and a surface 430 of the shovel 235.

Figure 4D:
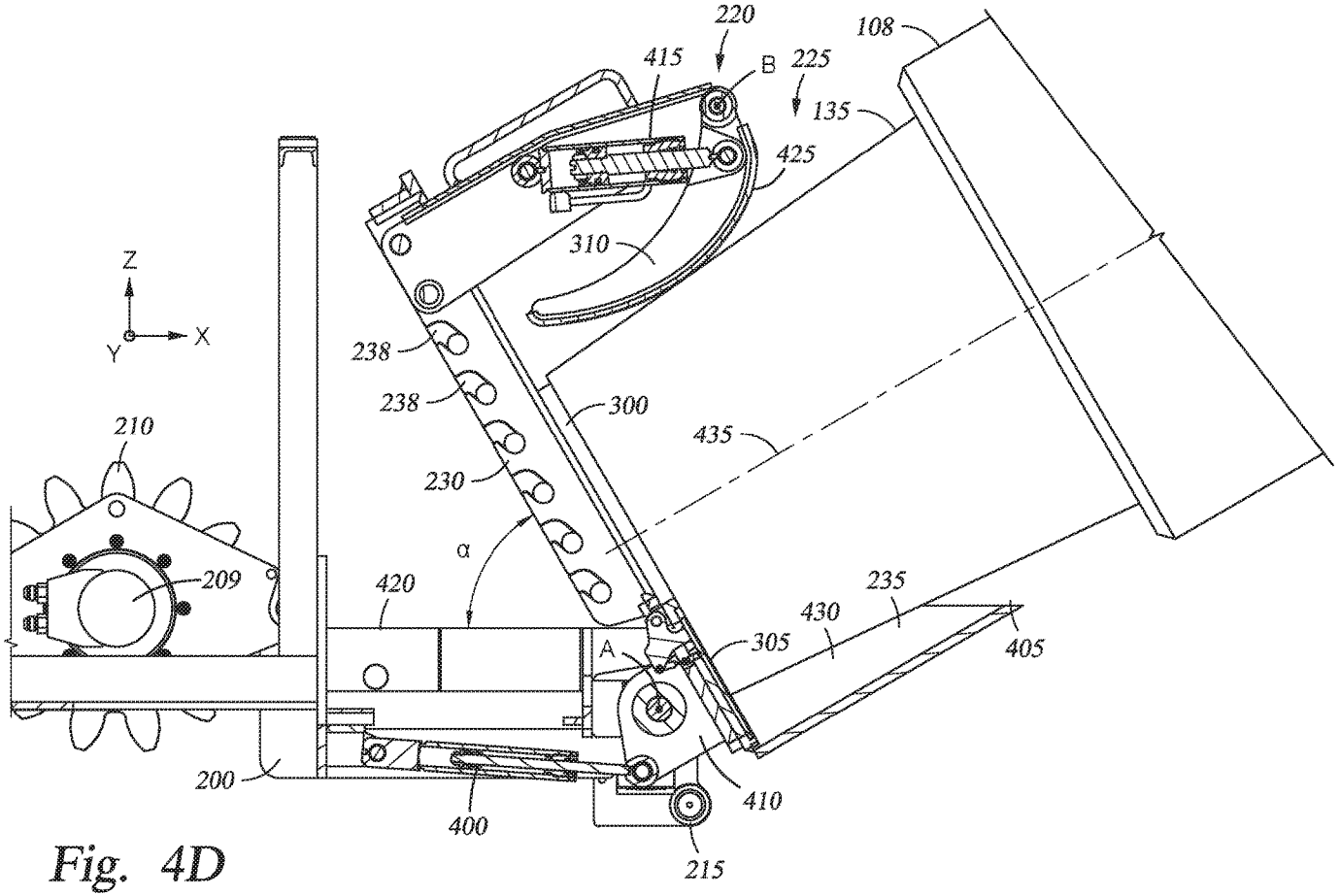

FIG. 4D shows the pin end 135 of the tubular 108 secured in the grip device 220 as well as the rotation of the grip device 220 and the shovel 235 about axis A. The rotation may be provided by the angular position of a longitudinal axis 435 of the tubular 108 as the tubular 108 is being lifted onto the drill floor. The rotation may also be controlled by the actuator 400. For example, the tubular 108 is being pulled and/or lifted by the elevator 125 (shown in FIG. 1) during transfer to the drill floor 110 (shown in FIG. 1). At the same time, the skate 130 is pushing the pin end 135 of the tubular 108 toward the drill floor 110. As such, the longitudinal axis 435 of the tubular is transitioning from a horizontal or near horizontal orientation to a vertical orientation, and the skate 130 is getting closer to the drill floor 110. The skate 130 may be moved toward the drill floor 110 along the trough 115 of the catwalk 105 based on the upward movement of the elevator 125 (i.e., velocity at which the elevator is lifting the tubular and distance between the elevator and the drill floor). The angle a between the plate 300 of the grip device 220 and the plane 420 of the frame 200 may be at or near 0 degrees when the skate 130 reaches the end of the trough 115 of the catwalk 105 (or at a point where the tubular is substantially vertical). At this point, the grip member 310 may be deactivated and retracted to allow the pin end 135 of the tubular 108 to be released.

The grip device 220 maintains control of the pin end 135 of the tubular 108 during the horizontal to vertical transition of a tubular (during a catwalk to drill floor transfer) as well a vertical to horizontal transition of a tubular (during a drill floor to catwalk transfer). When the tubular 108 is to be transferred from the drill floor 110 to the catwalk 105, the grip device 220 may be actuated by the actuator 400 to a position such that the angle $\alpha$ may be at or near 0 degrees to receive the pin end 135 of the tubular 108. The pin end 135 of the tubular 108 may be received in the grip device 220 and contact the switch plate 305 to engage the pin end 135 of the tubular 108. The skate 130 may be moved away from the drill floor 110 along the trough 115 based on the downward movement of the elevator 125 (i.e., velocity at which the elevator is lowering the tubular and distance between the elevator and the drill floor). Once the tubular 108 is horizontal or near horizontal and supported by the trough 115, the grip device 220 can be deactivated and retracted. The skate 130 may be moved away from the tubular 108 and the tubular 108 may be removed from the trough 115.

Figure 5:
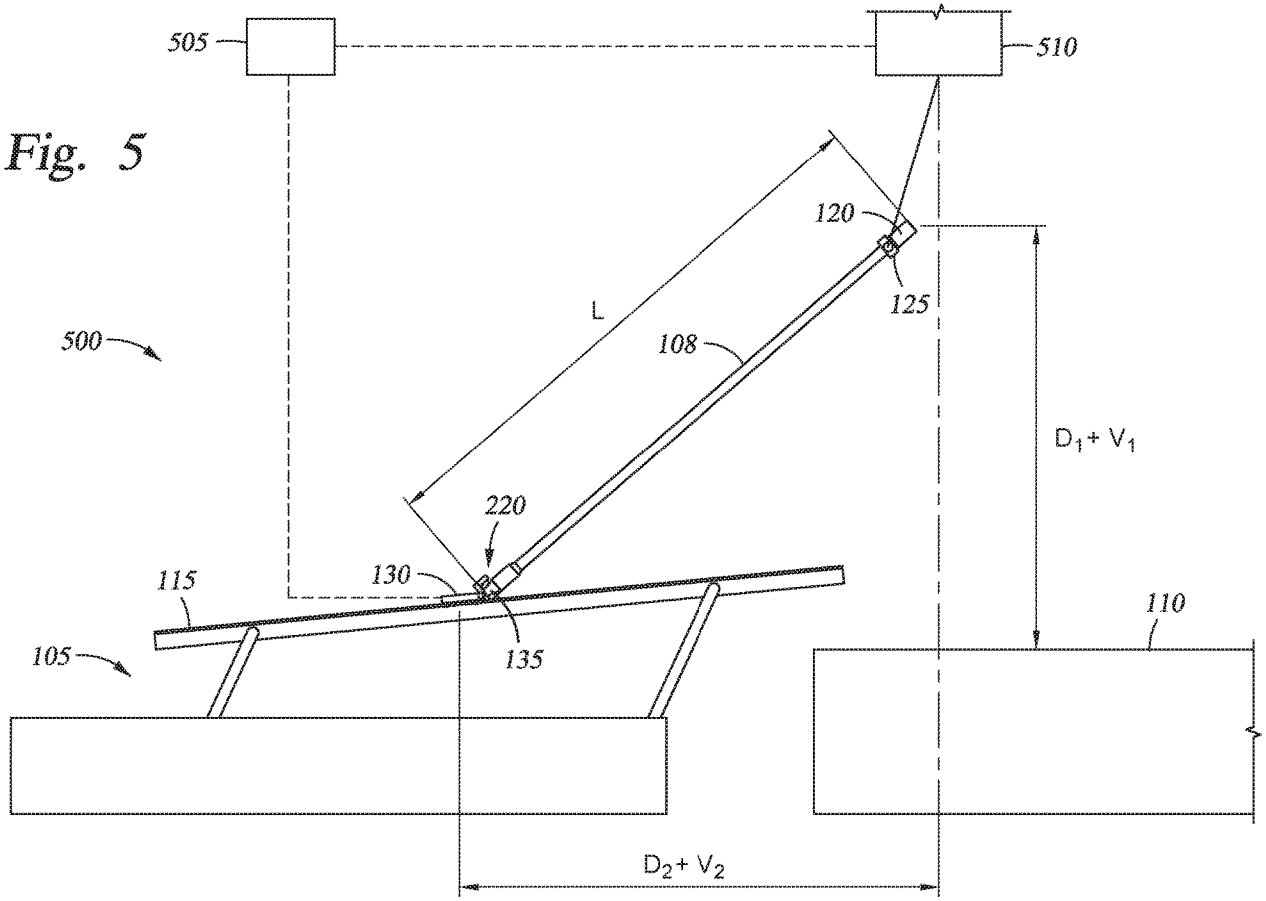
FIG. 5 is a schematic diagram of a control system for controlling the transfer of a tubular along a catwalk using the skate as described herein.

FIG. 5 is a schematic diagram of a control system 500 for controlling the transfer of a tubular 108 using the skate 130. A controller 505 is in communication with the skate 130 and a tubular lifting system 510, which includes the elevator 125. The controller 505 is configured to control the movement of the skate 130 to maintain a grip in the pin end of the tubular 108 during raising or lowering of the tubular 108 by the elevator 105. A length L of the tubular 108 is known, and the distance $D_1$, as well as the velocity $V_1$ of the elevator 125, is input into the controller 505. Using the distance $D_1$ and the velocity $V_1$, a position (distance $D_2$) and speed (velocity $V_2$) for the skate 130 may be determined by the controller 105. Therefore, the skate 130 is consistently in a position and is moving at a speed on the trough 115 based on the position and speed of the elevator 125 to maintain control of both ends of the tubular 108. Further, the controller 505 may also control the angle α (FIGS. 4B-4D) between the plate 300 of the grip device 220 and the plane 420 of the frame 200.

While the foregoing is directed to embodiments of the disclosure, other and further embodiments may be devised without departing from the basic scope thereof, and the scope thereof is determined by the claims that follow.

The invention claimed is:

1. A skate control system configured to engage a tubular while moving along a catwalk trough, the skate control system comprising:

a skate, comprising:

a frame having a drive system configured to move the tubular along the catwalk trough;

a grip device coupled to the frame and configured to grip a pin end of the tubular, wherein the grip device comprises a shovel configured to support the tubular, and the grip device and the shovel are rotatable about a first axis relative to the frame;

a first actuator coupled to the frame at a first end and to the grip device and the shovel at a second end via a hinge connection to rotate the grip device and the shovel about the first axis, and the first actuator is actuatable independent of the drive system; and a controller in communication with the drive system that controls a velocity of the skate based on movement of a box end of the tubular by a tubular lifting system.

2. The skate control system of claim 1, wherein the grip device further comprises:

a grip member comprising a gripping surface, and the grip member is rotatable about a second axis relative to the frame; and a second actuator that moves the gripping surface of the grip device between a position adjacent to the pin end, and a retracted position away from the pin end.

3. The skate control system of claim 1, wherein the grip device includes an adjustable clamp positionable along a length of a support member of the grip device, and the support member is disposed between the adjustable clamp and the shovel, and spacing between a gripping surface of the adjustable clamp and the shovel is adjustable by removing and inserting one or more fasteners into one or more slots formed in the support member.

4. The skate control system of claim 1, wherein the grip device includes a switch plate that controls a gripping surface of the grip device.

5. The skate control system of claim 4, wherein the switch plate is coupled to a second actuator configured to move the gripping surface of the grip device between a position adjacent to the pin end, and a retracted position away from the pin end.

6. A skate for coupling with a tubular along a length of a catwalk trough, the skate comprising:

a frame having a drive system for moving the tubular along the length of the catwalk trough;

a grip device disposed on the frame for gripping a pin end of the tubular, wherein the grip device comprises a shovel configured to support the tubular, and the grip device and the shovel are rotatable about a first axis relative to the frame;

a first actuator to rotate the grip device and the shovel about the first axis, and the first actuator is actuatable independent of the drive system; and a switch plate disposed on the grip device and configured to actuate the grip device such that a gripping surface of the grip device engages the pin end of the tubular when the pin end of the tubular contacts the switch plate.

7. The skate of claim 6, further comprising a controller in communication with the drive system that controls movement of the frame based on movement of a box end of the tubular.

8. The skate of claim 6, wherein the switch plate is coupled to an actuator configured to move the gripping surface of the grip device between a position adjacent to the pin end, and a retracted position away from the pin end.

9. The skate of claim 6, wherein the first actuator is coupled to the frame at a first end and to the grip device and the shovel at a second end via a hinge connection to rotate the grip device and the shovel about the first axis.

10. The skate of claim 9, wherein the grip device further comprises:

a second actuator that moves the gripping surface of the grip device between a position adjacent to the pin end, and a retracted position away from the pin end.

11. The skate of claim 6, wherein the grip device includes an adjustable clamp positionable along a length of a support member of the grip device, and the support member is disposed between the adjustable clamp and the shovel, and spacing between the gripping surface and the shovel is adjustable by removing and inserting one or more fasteners into one or more slots formed in the support member.

12. A method for conveying a tubular to a drill floor, the method comprising:

positioning the tubular on a catwalk trough;

coupling a box end of the tubular to an elevator;

engaging a pin end of the tubular with a skate, the skate comprising a drive system and a grip device having a shovel configured to support the tubular, and the grip device and the shovel are rotatable about a first axis;

actuating a first actuator to rotate the grip device and the shovel about the first axis, and the first actuator is actuatable independent of the drive system; and transferring the tubular by moving the skate along the catwalk trough to push the tubular while lifting the tubular with the elevator, wherein a controller in communication with the skate controls a position of the skate on the catwalk trough based on a position of the box end of the tubular, and wherein the controller controls a velocity of the skate on the catwalk trough in response to movement of the box end of the tubular by the elevator.

13. The method of claim 12, wherein the controller monitors a velocity and an elevation of the elevator relative to the drill floor to determine the position and the velocity of the skate.

14. The method of claim 12, wherein the pin end of the tubular is engaged between the shovel and the grip device disposed on the skate.

15. The method of claim 14, wherein the grip device and the shovel are rotatable about the first axis based on an angular orientation of the tubular during transfer of the tubular.

16. The method of claim 14, wherein the grip device comprises a gripping surface that is actuatable to a first position that grips the tubular and a second position that releases the tubular.

17. The method of claim 14, wherein the grip device includes an adjustable clamp positionable along a length of a support member of the grip device, and the support member is disposed between the adjustable clamp and the shovel, and a distance between the adjustable clamp and the shovel is adjustable by removing and inserting one or more fasteners into one or more slots formed in the support member.

18. The method of claim 12, wherein the velocity of the skate is based on a velocity of the box end of the tubular.

19. The method of claim 12, wherein the skate further comprises a frame, and the first actuator is coupled to the frame at a first end and to the grip device and the shovel at a second end via a hinge connection to rotate the grip device and the shovel about the first axis.

* * * * *